US007210432B2

(12) United States Patent
Rosskamp et al.

(10) Patent No.: US 7,210,432 B2
(45) Date of Patent: May 1, 2007

(54) INTERNAL COMBUSTION ENGINE

(75) Inventors: Heiko Rosskamp, Adelberg (DE); Jörg Schlossarczyk, Winnenden (DE); Konrad Knaus, Gaildorf (DE); Gerhard Osburg, Kernan (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/372,189

(22) Filed: Mar. 10, 2006

(65) Prior Publication Data

US 2006/0219195 A1 Oct. 5, 2006

(30) Foreign Application Priority Data

Mar. 31, 2005 (DE) ..... 10 2005 014 575

(51) Int. Cl.
*F02B 33/04* (2006.01)

(52) U.S. Cl. ..... 123/73 PP; 123/73 A

(58) Field of Classification Search ..... 123/73 R, 123/73 A, 73 PP
See application file for complete search history.

(56) References Cited

U.S. PATENT DOCUMENTS 3,797,467 A * 3/1974 Tenney ..... 123/73 AA
5,947,066 A * 9/1999 Ishikawa ..... 123/65 P
6,571,756 B1 6/2003 Rosskamp et al.

* cited by examiner

*Primary Examiner*—Noah P. Kamen
(74) *Attorney, Agent, or Firm*—Walter Ottesen

(57) ABSTRACT

A two-stroke engine is for a portable handheld work apparatus such as a motor-driven chain saw, cutoff machine, brushcutter or the like. A combustion chamber (3) is configured in the cylinder (2) of the engine (1) and is delimited by a reciprocating piston (5). The piston (5) drives a crankshaft (7) via a connecting rod (6). The crankshaft (7) is rotatably journalled in the crankcase (4). The two-stroke engine includes a discharge opening (10) for conducting exhaust gases out of the combustion chamber (3) and an inlet (11) via which an air/fuel mixture is conducted to the crankcase (4). The air/fuel mixture passes via at least one transfer channel (12, 15) from the crankcase (4) into the combustion chamber (3). The transfer channels (12, 15) open at one end with a transfer window (13, 16) into the combustion chamber (3) and are connected at the other end to the crankcase (4). A bypass channel (20) conducts essentially fuel-free gas and opens via a membrane valve (19) into the transfer channel (15). The sum of all areas of the inlet windows (13, 16) referred to the piston displacement of the engine is approximately 1.4 $mm^2/cm^3$ to approximately 5.90 $mm^2/cm^3$ whereby good exhaust-gas values are obtained at low fuel consumption.

11 Claims, 1 Drawing Sheet

INTERNAL COMBUSTION ENGINE

CROSS REFERENCE TO RELATED APPLICATION

This application claims priority of German patent application no. 10 2005 014 575.2, filed Mar. 31, 2005, the entire content of which is incorporated herein by reference.

FIELD OF THE INVENTION

The invention relates to an internal combustion engine, especially, a two-stroke engine for a portable handheld work apparatus such as a motor-driven chain saw, cutoff machine, brushcutter or the like.

BACKGROUND OF THE INVENTION

U.S. Pat. No. 6,571,756 discloses a two-stroke engine wherein an air/fuel mixture is drawn by suction into the crankcase and is moved into the combustion chamber via transfer channels during a downward travel of the piston. For reducing the scavenging losses, transfer channels, which are arranged near the outlet, are supplied with pure air via bypass channels and a controlled opening. When opening the transfer channels, pure air prestored in the bypass channel first flows into the combustion chamber whereby the afterflowing air/fuel mixture is intended to be curtained off with respect to the outlet. An essential component of the unavoidable scavenging losses, which are caused by construction, is formed by the inflowing air so that the component of the air/fuel mixture in the scavenging losses is reduced.

In practice, it has been determined that the fuel consumption and also the exhaust-gas behavior are not satisfactory, especially in two-stroke high-performance engines having a piston displacement of more than 50 $cm^3$ to, for example, 200 $cm^3$ and a capacity of more than 45 kW/l Vh (kilowatt per liter of piston displacement).

SUMMARY OF THE INVENTION

It is an object of the invention to provide a two-stroke engine of the kind described above wherein the engine has a good exhaust-gas performance with low fuel consumption.

The internal combustion engine of the invention, especially a two-stroke engine, is for a portable handheld work apparatus. The internal combustion engine of the invention has a predetermined piston displacement measured in $cm^3$ and includes: a crankcase; a cylinder connected to the crankcase; the cylinder having a cylinder wall defining a cylinder bore; a piston displaceably mounted in the cylinder bore and the piston and the cylinder conjointly defining a combustion chamber; a crankshaft rotatably mounted in the crankcase; a connecting rod connecting the piston to the crankshaft so as to permit the piston to drive the crankshaft as the piston reciprocates in the cylinder between bottom dead center and top dead center; the cylinder having a discharge outlet formed therein for conducting exhaust gases away from the combustion chamber; an inlet for conducting an air/fuel mixture to the crankcase; a transfer window; a transfer channel having a first end communicating with the combustion chamber via the transfer window and having a second end communicating with the crankcase for conducting the air/fuel mixture from the crankcase into the combustion chamber; a controlled opening; a bypass channel for conducting essentially fuel-free air; the controlled opening being interposed between the transfer channel and the bypass channel and the bypass channel communicating with the transfer channel via the controlled opening; the transfer window having an area measured in $mm^2$; and, the area and the piston displacement defining a ratio lying in a range of approximately 1.4 $mm^2/cm^3$ to 5.90 $mm^2/cm^3$.

Surprisingly, it has been shown that the ratio of the area of all transfer windows of the transfer channels to the piston displacement of the internal combustion engine (especially, for high performance engines in a piston displacement range of approximately 50 $cm^3$ to approximately 200 $cm^3$) has a decisive influence upon the fuel consumption and also on the exhaust-gas values. Surprisingly good values with reference to the fuel consumption as well as with reference to the exhaust-gas quality result in two-stroke engines wherein ratios are selected for which the sum of the areas of all transfer windows of the transfer channels in $mm^2$ is approximately a multiple of 1.4 to approximately 5.90 of the piston displacement of the engine in $cm^3$. Significantly better values are obtained when the ratio is selected in the range of 1.9 $mm^2/cm^3$ to 3.6 $mm^2/cm^3$.

Advantageously, the controlled openings, via which the air passes from the bypass channels into the transfer channels, are formed by membrane valves. Good exhaust-gas values and low fuel consumption values of the engine are obtained when the sum of the connecting areas of the membrane valves referred to the stroke volume of the engine is approximately 3.91 $mm^2/cm^3$ to approximately 5.6 $mm^2/cm^3$, especially, approximately 3.91 $mm^2/cm^3$ to approximately 5.00 $mm^2/cm^3$. The size of the connecting area of the membrane valve determines the air quantity, which flows into the transfer channel, in dependence upon the pressure ratios present. In this way, the ratio of the quantity of scavenging prestored air to the quantity of the air/fuel mixture, which flows into the combustion chamber, is determined. For a connecting area of the membrane valve of 3.91 $mm^2/cm^3$, low portions of the air/fuel mixture result in the scavenging losses and therefore also good exhaust-gas values are obtained.

It has been shown that also the sum of the widths of the inlet or transfer windows, which are measured in the peripheral direction of the transfer channels, has a decisive influence on the fuel consumption and exhaust-gas values of the internal combustion engine. It has been provided that the sum of the widths of the inlet windows of the transfer channels, which are measured in the direction of the periphery of the cylinder, is a multiple in the range of 0.44 to 2.2 of the diameter of the cylinder. Especially good exhaust-gas values can be obtained when the sum of the widths of the inlet windows of the transfer channels, which are measured in the direction of the periphery of the cylinder, is a multiple of 1.3 to 1.8 of the diameter of the cylinder.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
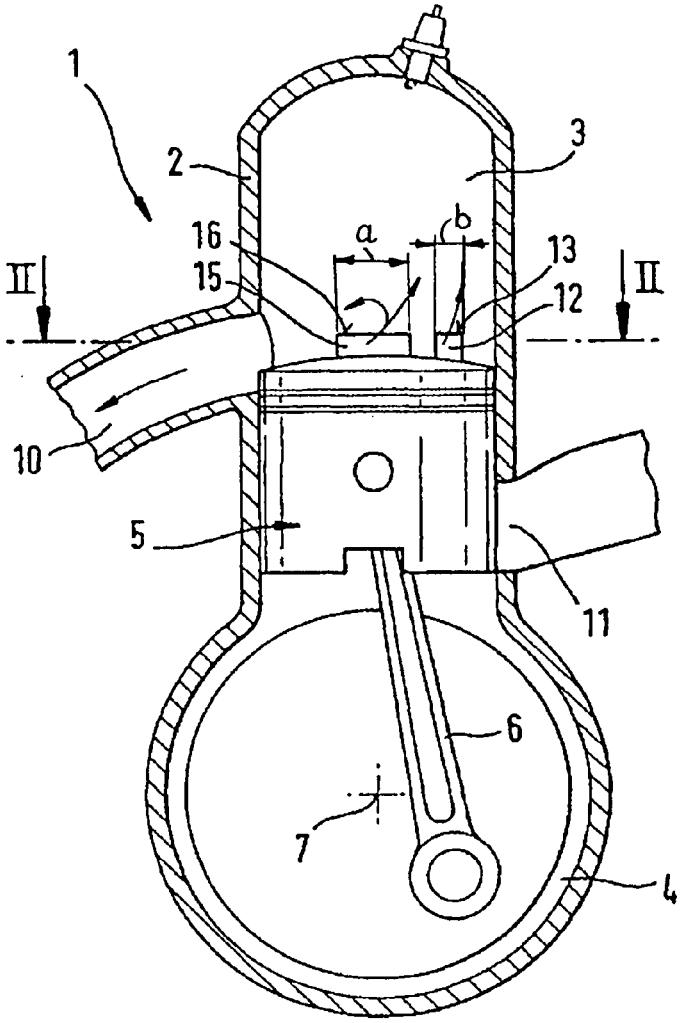
FIG. 1 is a side elevation view, in section, taken through a two-stroke engine having four transfer channels; and, FIG. 2 is a section view taken along line II—II of FIG. 1.

The internal combustion engine 1 shown in FIG. 1 is a two-stroke engine and is preferably configured as a high performance engine having a piston displacement lying in the range of approximately 50 $cm^3$ to approximately 200 $cm^3$ as well as especially a capacity of more than 45 kW/l Vh (kilowatt per liter of piston displacement). In cylinder 2, a combustion chamber 3 is formed which is delimited by a reciprocating piston 5. The piston 5 drives a crankshaft 7 via a connecting rod 6 and the crankshaft 7 is rotatably journalled in the crankcase 4. An air/fuel mixture flows into the crankcase 4 via the inlet 11. The crankcase 4 is connected to the combustion chamber 3 via four transfer channels (12, 15).

Figure 2:
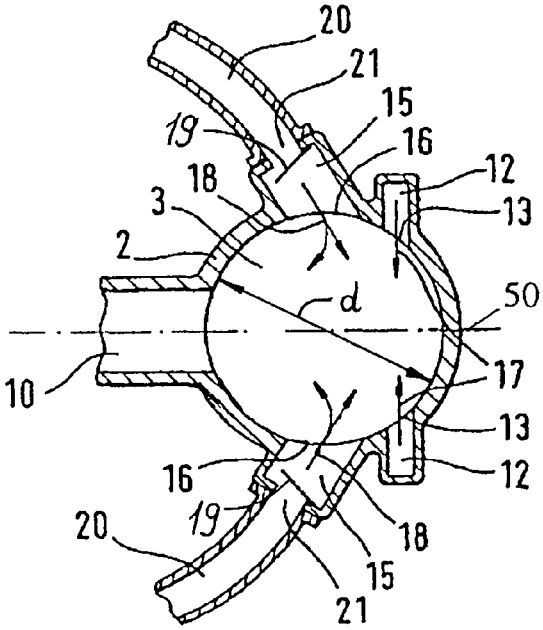

In the section view of FIG. 2 taken along line II—II of FIG. 1, the two transfer channels 12 having the inlet windows 13 and the two transfer channels 15 having the inlet windows 16 are shown. Bypass channels 20 open into the transfer channels 15 and conduct essentially fuel-free air, especially pure air. The bypass channels 20 are connected to the transfer channels 15 via controlled openings configured as membrane valves 19.

In the embodiment shown, the bypass channels 20 are connected to the outlet-near transfer channels 15. It can be advantageous to connect the bypass channels 20 to the outlet-near transfer channels 15 as well as to the outlet-remote transfer channels 12 in order to prestore air in all transfer channels (12, 15). The bypass channels 20 can also be connected to the transfer channels (12, 15) via a pocket formed in the piston 5 so that the connection is slot controlled.

During the upward stroke of the piston 5, the air/fuel mixture flows via the inlet 11 into the crankcase 4 and is there compressed in the subsequent downward stroke. During the upward stroke of the piston 5, pure air flows out of the bypass channels 20 into the transfer channels 15 because the transfer channels are open at their crankcase ends and the underpressure, which arises in the crankcase 4 during the upward stroke of the piston, acts simultaneously in all transfer channels (12, 15). Because of the underpressure in the transfer channel 15, the membrane valve 19 opens so that air can flow from the bypass channel into the transfer channels 15 and flows in a direction toward the crankcase 4. The membrane valve 19 controls the connecting opening from the bypass channel 20 to the transfer channel 15. When the piston 5 goes into the downward stroke after passing through top dead center, the pressure in the crankcase 4 changes to the overpressure. The membrane valves 19 close and block the transfer channel 15 with respect to the bypass channel 20. When the inlet windows (13, 16) of the transfer channels (12, 15) are opened by the downwardly moving piston 5, the air, which is present in the transfer channel 15, flows in the direction of arrow 18 into the combustion chamber 3 and displaces the exhaust-gases of the combustion of the previous stroke into the outlet 10. Exclusively an air/fuel mixture flows from the crankcase 4 into the combustion chamber 3 out of the inlet windows 13 of the transfer channels 12. After the air, which is prestored in the transfer channel 15 ahead of the air/fuel mixture, has flowed completely into the combustion chamber 3, a further air/fuel mixture flows into the combustion chamber 3 also from the inlet window 16 of the transfer channel 15.

The inlet or transfer windows (13, 16) of the transfer channels (12, 15) are so designed that the sum of their areas, which lie in the cylinder wall, referred to the stroke volume of the two-stroke engine 1 is a multiple of approximately 1.4 $mm^2/cm^3$ to approximately 5.90 $mm^2/cm^3$. Good exhaust-gas values are especially then obtained when the ratio of the sum of the areas of the inlet windows (13, 16) to the piston displacement of the engine 1 lies in a range of approximately 1.9 $mm^2/cm^3$ to 3.6 $mm^2/cm^3$. If, alternatively, or especially in addition to the design of the areas of the inlet windows (13, 16), also the connecting areas 21 of the membrane valves 19 are selected so large that the sum of all connecting areas 21 of the membrane valves 19 referred to the piston displacement of the engine 1 amounts to a multiple lying in the range of 3.91 $m^2/cm^3$ to 5.60 $mm^2/cm^3$ (especially 3.91 $mm^2/cm^3$ to 5.0 $mm^2/cm^3$), further improvements in the exhaust-gas quality are obtained. The dimensions are so selected that the total area of the inlet windows (13, 16) and the connecting areas 21 in $mm^2$ referred to the piston displacement of the two-stroke engine 1 in $cm^3$ lies in a range of approximately 6.56 $mm^2/cm^3$ to 11.50 $mm^2/cm^3$.

In the embodiment shown, a two-stroke engine has a total of four transfer channels (12, 15). Two transfer channels (12, 15) are arranged on each side of a longitudinal center plane 50. The longitudinal center plane 50 partitions the discharge outlet 10 symmetrically in the longitudinal direction as shown in FIG. 2. In a two-stroke engine, which has only one transfer channel on one side of the longitudinal center plane 50 (that is, a total of only two transfer channels), the inlet windows are configured to be correspondingly larger so that even for such a constructive configuration, the sum of the areas of the two inlet windows of the two-stroke engine referred to the piston displacement of the engine is approximately 1.4 $mm^2/cm^3$ to approximately 5.90 $mm^2/cm^3$.

As shown in FIG. 1, the inlet window 16 has a width (a), which is measured in the peripheral direction of the cylinder, and the inlet window 13 has a width (b). The sum of the widths (a, b) of the inlet windows (13, 16) (that is, in the embodiment shown, twice the width (a) and twice the width (b)), is preferably a multiple lying in the range of 0.44 to 2.2 of the diameter (d) of the cylinder 2 shown in FIG. 2. The sum of the widths (a, b) amounts preferably to a multiple lying in the range of 1.3 to 1.8 of the diameter (d) of the cylinder 2. For two transfer channels, which are arranged opposite each other, the sum of the widths of the inlet windows (that is, corresponding to twice the width of one inlet window) is likewise preferably a multiple of 0.44 to 2.2 of the diameter (d). For an arrangement of two in lieu of four transfer channels, the inlet windows are to be configured correspondingly wider.

It is understood that the foregoing description is that of the preferred embodiments of the invention and that various changes and modifications may be made thereto without departing from the spirit and scope of the invention as defined in the appended claims.

What is claimed is:

1. An internal combustion engine including a two-stroke engine for a portable handheld work apparatus, the internal combustion engine having a predetermined piston displacement measured in $cm^3$ and comprising:

a crankcase;

a cylinder connected to said crankcase;

said cylinder having a cylinder wall defining a cylinder bore;

a piston displaceably mounted in said cylinder bore and said piston and said cylinder conjointly defining a combustion chamber;

a crankshaft rotatably mounted in said crankcase;

a connecting rod connecting said piston to said crankshaft so as to permit said piston to drive said crankshaft as said piston reciprocates in said cylinder between bottom dead center and top dead center;

said cylinder having a discharge outlet formed therein for conducting exhaust gases away from said combustion chamber;

an inlet for conducting an air/fuel mixture to said crankcase;

a transfer window;

a transfer channel having a first end communicating with said combustion chamber via said transfer window and having a second end communicating with said crankcase for conducting said air/fuel mixture from said crankcase into said combustion chamber;

a controlled opening;

a bypass channel for conducting essentially fuel-free air;

said controlled opening being interposed between said transfer channel and said bypass channel and said bypass channel communicating with said transfer channel via said controlled opening;

said transfer window having an area measured in $mm^2$; and, said area and said piston displacement defining a ratio lying in a range of approximately 1.4 $mm^2/cm^3$ to 5.90 $mm^2/cm^3$.

2. The internal combustion engine of claim 1, wherein said portable handheld work apparatus includes a motor-driven chain saw, cutoff machine, brushcutter or the like.

3. An internal combustion engine including a two-stroke engine for a portable handheld work apparatus, the internal combustion engine having a predetermined piston displacement measured in $cm^3$ and comprising:

a crankcase;

a cylinder connected to said crankcase;

said cylinder having a cylinder wall defining a cylinder bore;

a piston displaceably mounted in said cylinder bore and said piston and said cylinder conjointly defining a combustion chamber;

a crankshaft rotatably mounted in said crankcase;

a connecting rod connecting said piston to said crankshaft so as to permit said piston to drive said crankshaft as said piston reciprocates in said cylinder between bottom dead center and top dead center;

said cylinder having a discharge outlet formed therein for conducting exhaust gases away from said combustion chamber;

an inlet for conducting an air/fuel mixture to said crankcase;

a plurality of transfer windows;

a plurality of transfer channels having respective first ends communicating with said combustion chamber via corresponding ones of said transfer windows and having respective second ends communicating with said crankcase for conducting said air/fuel mixture from said crankcase into said combustion chamber;

a plurality of controlled openings;

a plurality of bypass channels for conducting essentially fuel-free air;

said controlled openings being interposed between said bypass channels and corresponding ones of selected ones of said transfer channels;

said bypass channels communicating with said selected ones of said transfer channels via corresponding ones of said controlled openings;

said transfer windows each having an area measured in $mm^2$; and, the sum of said areas and said piston displacement defining a ratio lying in a range of approximately 1.4 $mm^2/cm^3$ to 5.90 $mm^2/cm^3$.

4. The internal combustion engine of claim 3, wherein said sum of said areas and said piston displacement defines a ratio lying in a range of approximately 1.9 $mm^2/cm^3$ to 3.6 $mm^2/cm^3$.

5. The internal combustion engine of claim 3, wherein each of said controlled openings is defined by a membrane valve.

6. The internal combustion engine of claim 5, wherein each of said membrane valves defines a connecting area and the sum of said connecting areas and said piston displacement defines a ratio lying in a range of approximately 3.91 $mm^2/cm^3$ to 5.60 $mm^2/cm^3$.

7. The internal combustion engine of claim 5, wherein each of said membrane valves defines a connecting area and the sum of said connecting areas and said piston displacement defines a ratio lying in a range of approximately 3.91 $mm^2/cm^3$ to 5.00 $mm^2/cm^3$.

8. The internal combustion engine of claim 3, wherein said internal combustion engine has a piston displacement lying in the range of approximately 50 $cm^3$ to approximately 200 $cm^3$.

9. The internal combustion engine of claim 3, wherein said internal combustion engine has a capacity of 45 kW/l Vh.

10. The internal combustion engine of claim 3, wherein the widths (a, b) of said transfer windows are measured in the peripheral direction of said cylinder; and, the sum of said widths (a, b) of said transfer windows of said transfer channels lies in the range of 0.44 to 2.2 times the diameter (d) of said cylinder.

11. The internal combustion engine of claim 3, wherein the widths (a, b) of said transfer windows are measured in the peripheral direction of said cylinder; and, the sum of said widths (a, b) of said transfer windows of said transfer channels lies in the range of 1.3 times to 1.8 times the diameter (d) of said cylinder.

* * * * *